United States Patent [19]

Leidy

[11] Patent Number: 4,531,745

[45] Date of Patent: Jul. 30, 1985

[54] THREE FOR ALL ROPE RING TOSS DEVICE

[76] Inventor: Donald E. Leidy, 7414 School Ave., Baltimore, Md. 21222

[21] Appl. No.: 434,409

[22] Filed: Jan. 6, 1983

[51] Int. Cl.[3] ..... A63B 67/06

[52] U.S. Cl. ..... 273/336; 273/425

[58] Field of Search ..... 273/336, 337, 338, 339, 273/424, 425; 63/2, 3; 46/1 G; D21/4, , 50; D11/3, 26

[56] References Cited

U.S. PATENT DOCUMENTS

| | | | |
|---|---|---|---|
| D. 230,625 | 3/1974 | Mechanic | D11/26 |
| 429,531 | 6/1890 | Johnstone | 273/425 |
| 1,230,503 | 6/1917 | Miller | 273/336 |
| 1,530,816 | 3/1925 | Dodge | 273/425 |
| 1,532,576 | 4/1925 | Carlson | 273/336 |
| 1,617,127 | 2/1927 | Levay | 273/339 |
| 2,365,513 | 12/1944 | Bartle et al. | 273/339 |
| 2,669,221 | 2/1954 | Major | 119/153 |
| 3,119,619 | 1/1964 | Frank | 273/336 |
| 3,421,762 | 1/1969 | Paradise | 273/339 |
| 3,817,520 | 6/1974 | Burgos | 273/411 X |
| 3,823,942 | 7/1974 | Duncan | 273/338 X |

*Primary Examiner*—William H. Grieb

*Attorney, Agent, or Firm*—Richard M. McMahon

[57] ABSTRACT

This invention relates to a new article of manufacture. The invention consists of an improved ring toss game with a new rope ring having three or more separate but interconnected circular rope coils and a fixed peg target mounted on a wall or vertical support or floating on water. This fixed peg target may also be mounted on the ground or floor base. The game has many possible variations such as changing the angle or position of peg, the number of points required to win, the maximum number of tosses in a game, or the circular size of the rope ring.

10 Claims, 8 Drawing Figures

THREE FOR ALL ROPE RING TOSS DEVICE

SUMMARY AND BACKGROUNG OF THE INVENTION

The present invention relates to a new and improved game of skill suitable for indoor and outdoor entertainment which is capable of being played by one or more players. More particularly, my invention pertains to an improved rope ring toss game with a new and improved rope ring toss game rope ring structure containing three separate but interconnected circular rope coils.

There are many different ring games of skill and each of those games has a specific novel aspect which differentiates each ring game from one another. My invention provides an improved rope ring device with a single rope spliced or joined together to form three or more coils and a peg which can be placed at different angles to the thrower to make the game more difficult and entertaining.

Other devices which have been proposed disclose a rope ring such as that used in quoits or a ring made of section of flexible link chain. Still other devices disclose interconnected multiple hoops of different rigid structures. None of these devices show a rope structure with three or more separate but interconnected flexible circular rope coils. Other proposed devices do not disclose the optical effect on the thrower in a game of skill with the peg placed at a sharp angle towards the thrower as disclosed in my invention. An object of this invention is a game device having fixed peg for which the angle can be changed to create this optical effect on the thrower.

A further object of this invention is to provide a fixed peg which can be easily mounted or dismounted on a wall, vertical support, or mounted on the ground, or floated on water. Another object of the present invention is to provide a full variety of games of skill by changing angle of the peg, or the length of a game in points, or the number of tosses, or the circular size of the rope ring.

A further unique feature of this invention relates to a single rope spliced or joined together to form three or more separate coils. This novel feature permits the rope ring to maintain the original circular shape and rigidity, thus increasing the useful life of the device in many hours of service. Still a further object of the present invention is provide a peg target and rope ring assembly which can be made easily and economically with mass production techniques.

This invention possesses other objects and features of advantage which will become apparent from the following description taken in conjunction with the accompanying drawings.

DETAILED DESCRIPTION

Figure 1:
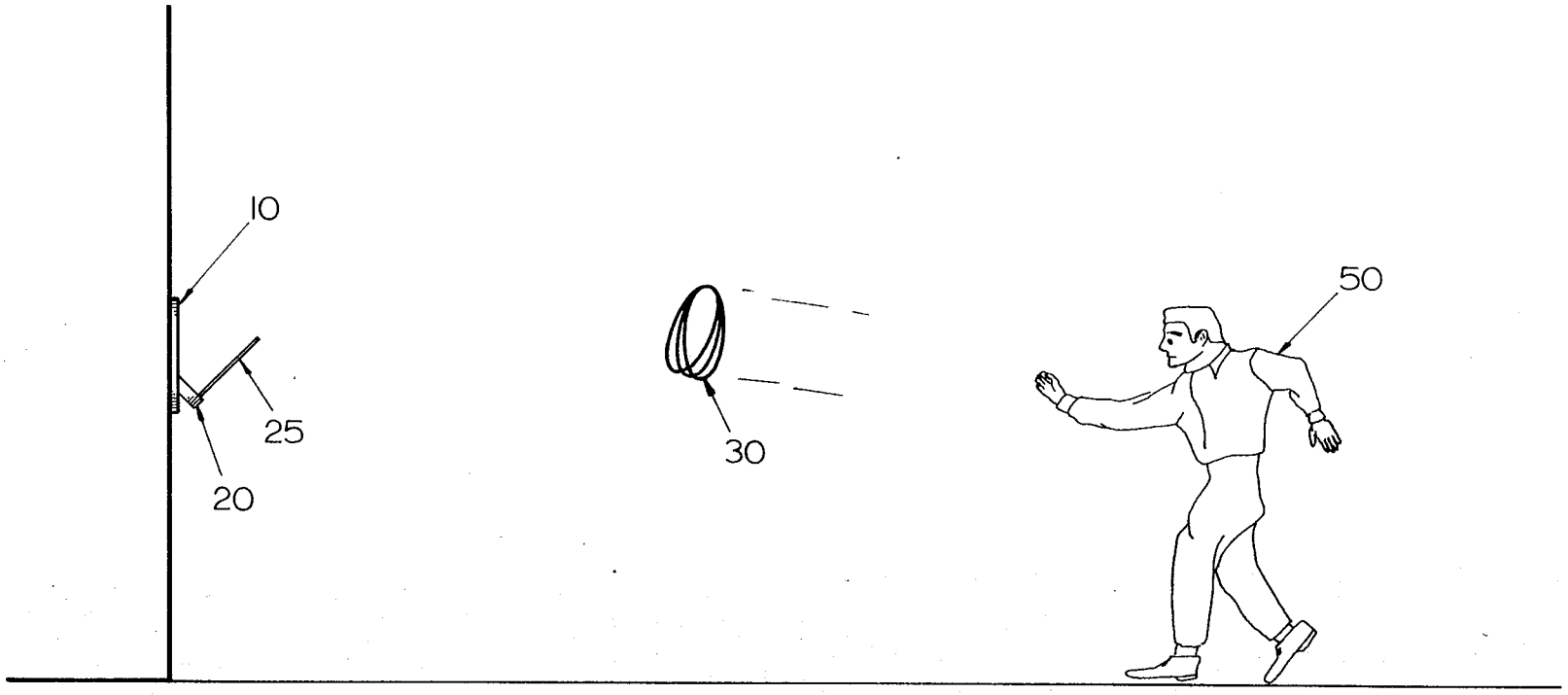
FIG. 1 is a perspective view of The Three for All Rope Ring Toss device showing the invention in use with a thrower tossing the rope ring.

Referring to the drawings for a better understanding of the present invention, as shown in FIG. 1, the Three for All Rope Ring Toss Device is depicted as it is in use as a game of skill with the rope ring 30 containing three separate but interconnected rope coils being tossed by the player 50 towards the fixed peg device 10 with the object being to get one or more of the rope coils over the peg 25. Cylindrical peg 25 is inserted and attached to the peg base which is affixed to the vertical mounting base 10.

Figure 3:
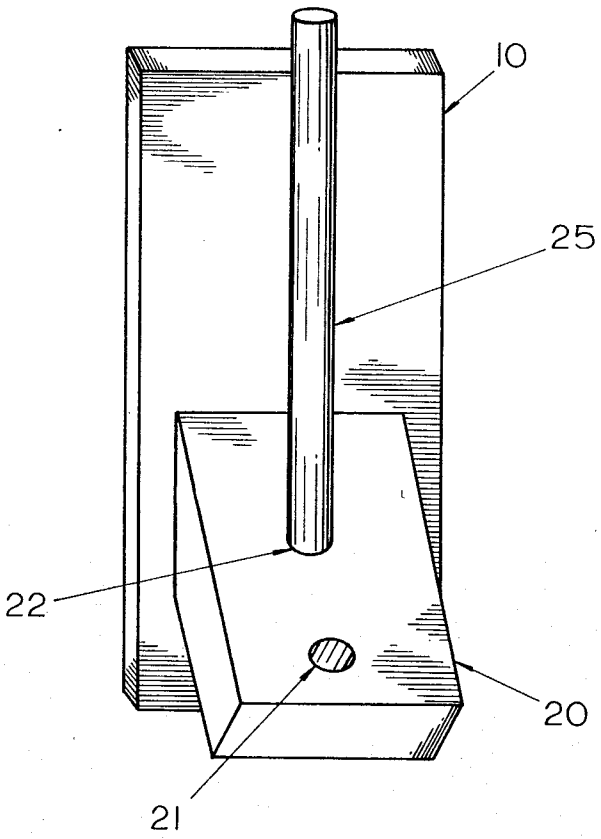
FIG. 3 is a perspective view of the fixed peg target device with the peg vertical.
Figure 2:
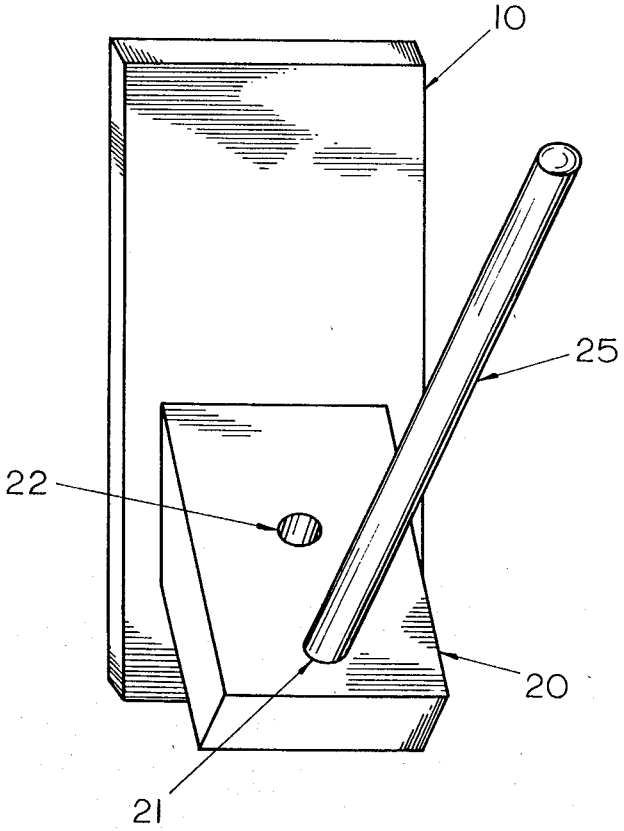
FIG. 2 is a perspective view of the fixed peg target device with the peg at a 45 degree angle towards the thrower.

As shown in FIG. 2 and FIG. 3, the position of peg 25 in peg base 20 can be changed to alter the angle of the peg in relation to vertical mounting base 10. In FIG. 2, inserting peg 25 in hole 21, which is positioned at a 45 degree angle from the vertical, results in the peg appearing to be much closer to the thrower. FIG. 3 depicts peg 25 inserted in hole 22, which is positioned parallel to vertical mounting base 10, resulting in peg 25 being vertical in relation to the thrower and parallel to mounting base 10.

The fixed peg target assembly comprised of peg 25 is inserted and held in position by one of the peg support holes 21 or 22 contained in peg base 20 affixed to the vertical mounting base 10. The fixed peg target assembly can be made of wood or any suitable plastic, such as high impact polystrene or Polypropylene which will permit this device to float on water.

Figure 4:
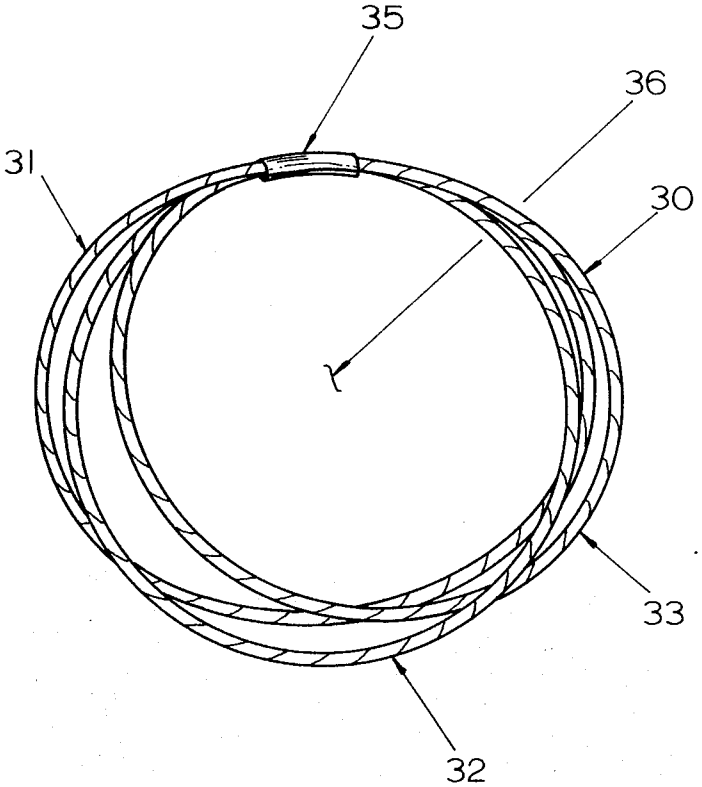
FIG. 4 is a side plan view of a the rope ring showing three separate pieces of rope joined together with a connector to form three separate interconnected coils.

FIG. 4 shows circular rope ring 30 with three separate circular coils 31, 32, and 33 interconnected by rope connector 35. An improvement in ring rigidity, maintainence of circular shape, and extension of useful life, and less frequent replacement is achieved with rope ring 30 because of having three or more interconnected circular coils.

Figure 5:
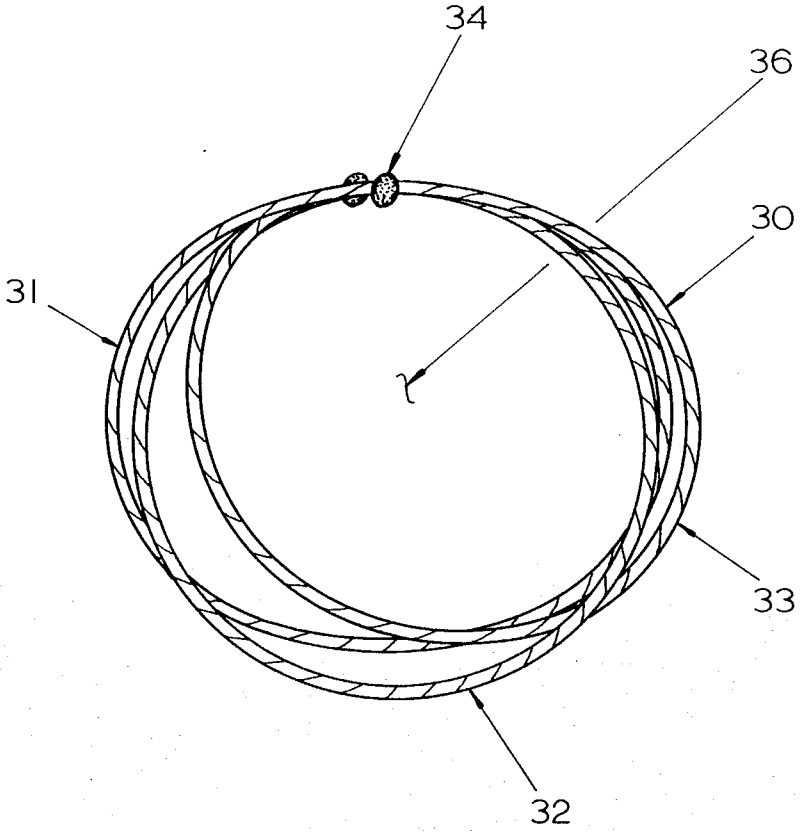
FIG. 5 is a side plan view of the rope ring showing a single piece of rope spliced together to form three interconnected separate coils.

FIG. 5 shows circular rope ring 30 with three separate circular coils 31, 32, and 33 interconnected by splice 34 from a single piece of rope. The procedure of splicing rope together is a well known practice which is used extensively. Forming of three separate coils interconnected by splice 34, as shown in FIG. 5, permits rope ring 30 to maintain a circular shape and rigidity for a much longer period of time than a single rope coil constructed of identical material. The useful life of the circular rope ring is extended giving rise to more hours of service and thereby reducing replacement cost. Circular rope ring 30 can be constructed of rope of varying weights, thicknesses, or number of interwoven strands thereby giving a full range of lighter more flexible rope rings to heavy duty more rigid rope rings. Rope ring 30, with separate interconnected coils 31, 32, and 33 can be fabricated with a smaller inside diameter 36 so as to make the skill level more difficult to throw rope ring over the peg.

A further variation possible with circular rope ring 30 is to fabricate the interconnected circular coils with more than the three coils as shown in FIGS. 4 and 5. Three interconnected rope coils are shown as the preferred design, but are intended to be only illustrative of the principles depicted by this invention.

Figure 6:
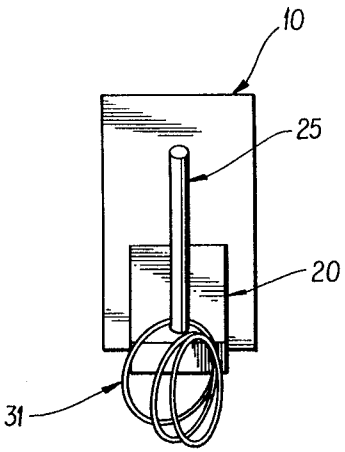
FIG. 6 is perspective view of the mounted peg device with one coil of a three coil rope ring tossed over the peg.

FIG. 6 shows a possible variation of the game with one coil 31 of circular rope ring 30 thrown over peg 25. A score of one point can be assigned for this achievement.

Figure 7:
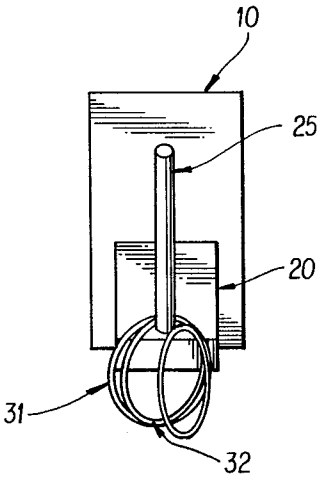
FIG. 7 is a perspective view of the mounted peg device with two coils of a three coil rope ring tossed over the peg.

FIG. 7 shows two coils 31 and 32 of circular rope ring 30 thrown over peg 25. A score of two points can be assigned for this achievement.

Figure 8:
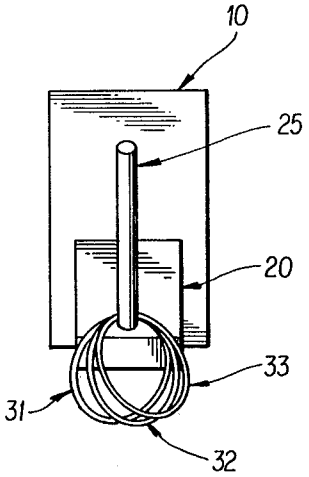
FIG. 8 is a perspective view of the mounted peg device with all three coils of a rope ring tossed over the peg.

FIG. 8 shows three coils 31, 32, and 33 of circular rope ring 30 thrown over peg 25. A score of three points can be assigned for this achievement.

There are many further variations of the ring toss game possible with this invention. One example is that one fixed peg target device 10 can be placed at each end of a court and the ring toss game played in a manner similar to that of horseshoes with the first thrower or team to reach 11 points or 21 points being declared the winner. A different game can similarly be played with each of two players being given three separate rope ring devices 30 representing three "outs" for each "inning" in a ring toss game played like the traditional game of baseball. This type of game consists of nine "innings" with the higher point score player being declared the winner.

Rope ring device 30 can be fabricated of different materials such; as sisal hemp rope, polyethylene, polypropylene, or nylon. Varying thicknesses of rope strand can be used to achieve lightweight or heavy duty rope ring devices 30 as shown in FIGS. 4 and 5. All of the rope ring toss devices constructed in accordance with this invention will float on water. Different colors of rope can be used to differentiate the rope ring toss device 30 for varying numbers of players.

The preferred component parts of a full ring toss game set constructed in accordance with this invention would include two fixed peg target devices 10 and six rope ring toss devices 30 with three of the rope ring toss devices 30 being constructed of one color rope, such as red, and three of rope ring toss devices being fabricated of a different color rope, such as blue. Other rope ring toss devices 30 of different colors could be added to a set to expand it for further use in many other game variations by multiple players. The rope ring toss game described can also be played in a swimming pool as all of the devices described herein will float on water.

Because other variations, sizes, shapes, colors, materials, changes, and modifications may be made to the embodiments described, it is intended that all matters in the foregoing description be interpreted as illustrative and not as limitations of my invention or the scope of the appended claims.

What I claim as new and desire to secure by Letters of Patent of the United States is:

1. A new article of manufacture comprising a circular rope ring having three or more separate circular rope coils formed from a single length of flexible strand of rope and interconnected bu a rope splice.

2. A new article of manufacture as claimed in claim 1 where the said length of flexible strand rope is colored polypropylene plastic material.

3. An improved ring toss game comprising:

a fixed peg target assembly comprised of a cylindrical peg inserted and held in position in one of the two recessed holes contained in a peg base affixed to the vertical mounting base;

said peg base is affixed to the vertical mounting base at end opposite of recessed holes, said first recessed hole is positioned in the peg base so that the cylindrical peg when inserted will form a 45 degree angle in relation to vertical position of the fixed peg target assembly;

said second recessed hole is positioned in the peg base so that the inserted cylindrical peg will be parallel to the vertical mounting base of said fixed peg target assembly;

said fixed peg target assembly is fabricated of wood or suitable plastic material;

wherein a player throws a circular rope ring formed by three or more separate circular rope coils formed of colored strands of sisal hemp, nylon, or polypropylene rope and interconnected by a connector;

at the said cylindrical peg whereby the object of the game is to throw the said circular rope ring over the said cylindrical peg.

4. A game as claimed in claim 3 wherein the fixed peg target assembly in constructed of colored high impact polystrene or colored polypropylene plastic material.

5. A game as claimed in claim 3 wherein the circular rope ring formed by three or more separate rope coils is interconnected by a rope splice.

6. A game as claimed in claim 3 wherein the circular rope ring formed by three or more separate rope coils is interconnected by a flexible plastic connector.

7. A game comprising:

a fixed peg target assembly comprised of a cylindrical peg inserted and held in position in one of the two recessed holes contained in a peg base affixed to the vertical mounting base; wherein a player throws a circular rope ring formed by three or more circular rope coils formed of colored flexible strand rope and interconnected by a splice or flexible connector, at a cylindrical peg inserted in the said fixed peg target assembly whereby different point values are assigned corresponding to the number of circular rope coils of the said circular rope ring thrown over the said cylindrical peg.

8. An improved ring toss game as claimed in claim 7 wherein two fixed peg target assemblies are placed at opposite ends of a court;

said game is played to a fixed point game value or played with a fixed number of rope ring tosses whereby the object of the game is to achieve the highest point score.

9. An improved ring toss game as claimed in claim 9 wherein the diameter of the said circular rope ring formed by three or more separate circular rope coils interconnected by a flexible connector is reduced to increase the skill level required.

10. An improved ring toss game as claimed in claim 7 wherein two fixed peg target assemblies are floated in water at opposite ends of a pool; said game is played to a fixed point game value or played with a fixed number of rope ring tosses whereby the object of the game is to achieve the highest point score.

* * * * *